US008341775B2

(12) United States Patent
Didehvar

(10) Patent No.: US 8,341,775 B2
(45) Date of Patent: Jan. 1, 2013

(54) ADJUSTABLE CURVED DOUBLE CURTAIN ROD SHOWER ASSEMBLY

(75) Inventor: Kaveh Didehvar, Hockessin, DE (US)

(73) Assignee: Zenith Products Corporation, New Castle, DE (US)

( * ) Notice: Subject to any disclaimer, the term of this patent is extended or adjusted under 35 U.S.C. 154(b) by 964 days.

(21) Appl. No.: 12/157,376

(22) Filed: Jun. 10, 2008

(65) Prior Publication Data

US 2009/0300838 A1 Dec. 10, 2009

(51) Int. Cl.
*A47H 1/08* (2006.01)
*A47H 1/10* (2006.01)
*A47H 1/14* (2006.01)

(52) U.S. Cl. ..... 4/608; 4/558; 4/610; 248/263; 248/264; 211/105.3; 160/335

(58) Field of Classification Search ..... 4/655, 610, 4/558, 608; 248/644, 200.1, 254–272; 160/39, 160/21, 334–335; 211/105.3, 105.2, 105.5, 211/123, 182
See application file for complete search history.

(56) References Cited

U.S. PATENT DOCUMENTS

| | | | | |
|---|---|---|---|---|
| 2,150,204 | A * | 3/1939 | Boye | 211/105.3 |
| 2,194,064 | A * | 3/1940 | Boye | 248/261 |
| 2,195,979 | A * | 4/1940 | Ziolkowski | 211/105.2 |
| 2,250,003 | A * | 7/1941 | Boye | 160/21 |
| 2,458,643 | A * | 1/1949 | Riley | 248/263 |
| 3,023,909 | A * | 3/1962 | Martens | 211/105.3 |
| 4,399,917 | A | 8/1983 | Ohman | |
| 4,461,056 | A | 7/1984 | Solinski | |
| 5,022,104 | A | 6/1991 | Miller | |
| D397,928 | S | 9/1998 | Wise | |
| D426,142 | S | 6/2000 | Moore | |
| 6,101,675 | A | 8/2000 | Goldstein | |
| 6,216,287 | B1 * | 4/2001 | Wise | 4/610 |
| 6,263,523 | B1 | 7/2001 | Moore | |
| 8,056,873 | B1 * | 11/2011 | Hanley et al. | 248/264 |
| 2003/0052070 | A1 * | 3/2003 | Weisenburger | 211/70.8 |
| 2005/0268394 | A1 * | 12/2005 | Monk et al. | 4/558 |
| 2007/0006377 | A1 * | 1/2007 | Moore | 4/558 |

FOREIGN PATENT DOCUMENTS

GB 2426693 A * 12/2006

* cited by examiner

*Primary Examiner* — Jeanette E. Chapman
(74) *Attorney, Agent, or Firm* — Panitch Schwarze Belisario & Nadel LLP

(57) ABSTRACT

An adjustable curved double curtain rod shower assembly for hanging and supporting the weight of two shower curtains and attached to the walls of a shower area and forms a shower enclosure area and the curtain rod assembly comprises:

(a) two adjustable curved curtain rods in a horizontal plane one an inner rod and the second an outer rod and each rod comprises a first and a second tubular section wherein the first section fits into the second section thereby providing for telescopic adjustment of each of the rods and two end pieces that join the ends of each of the two adjustable rods together;

(b) two end hanging means having pivotably positioned therein the two end pieces wherein each of the hanging means is attached to the walls of the shower enclosure and when shower curtains are attached to each of the rods form an enclosed shower area.

5 Claims, 5 Drawing Sheets

ADJUSTABLE CURVED DOUBLE CURTAIN ROD SHOWER ASSEMBLY

FIELD OF INVENTION

The invention relates to an assembly for a shower curtain for a shower enclosure.

BACKGROUND OF THE INVENTION

In a typical bathroom having a bathtub shower, the bathtub shower is enclosed with three walls with the fourth side being open to allow for entering and exiting the bathtub shower. A shower nozzle is placed above the tub on one side of the enclosure. Typically, a shower curtain is hung over the open side to prevent water from splashing into the bathroom while the shower is in use. The problem is to position the shower curtain in such a manner to prevent leakage of water into the bathroom. For example, if the bathtub is curved and the shower curtain rod on which the curtain hung is straight, water can readily seep into the bathroom while the shower is in use.

Miller, U.S. Pat. No. 5,022,104 issued Jun. 11, 1991 shows a straight shower curtain rod support mounted on opposing wall brackets in which the shower curtain is in alignment with a straight bathtub to form a shower enclosure. Wise, U.S. Pat. No. 6,216,287 issued Apr. 17, 2001 shows a single curved shower curtain rod support mounted over a curved bathtub to form a shower enclosure. Solinski, U.S. Pat. No. 4,461,056 issued Jul. 24, 1984 shows a double curtain rod assembly wherein the outer rod is straight and the inner rod is curved at both ends but the assembly basically is designed to be used with a straight rather than a curved bathtub.

Since there are a variety of bathtubs with different shapes and designs, there is a need for a curtain shower rod assembly to form a shower enclosure with a bathtub or another shower base that on installation can easily be fitted to these various bathtub designs and has double rods for hanging of two shower curtains to effectively reduce spraying and splashing of water while the shower is in use. The adjustable curved double curtain rod shower assembly provides the above.

SUMMARY OF THE INVENTION

An adjustable curved double curtain rod shower assembly for hanging and supporting the weight of two shower curtains and being attached to one wall and to the opposite wall of a shower area which forms a shower enclosure area and the curtain rod assembly comprises:

(a) two adjustable curved curtain rods in a horizontal plane one is an inner rod and the second is an outer rod and each rod comprises a first and a second tubular section wherein the first section fits into the second section thereby providing for telescopic adjustment of each of the rods and two end pieces join the ends of each of the two adjustable rods together;

(b) two end hanging means having pivotably positioned therein the two end pieces wherein each of the hanging means is attached to the wall and to the opposite wall of the shower enclosure thereby when shower curtains being attached to each of the rods form an enclosed shower area which prevents splashing of water out of the enclosed shower area when the shower is in use.

DETAILED DESCRIPTION OF THE INVENTION

The adjustable double curtain rod shower assembly has the advantage that it can be adjusted to fit within the open side of a shower enclosure. The inner and outer telescopic adjustable tubes can be adjusted to fit in the open side of the shower enclosure and the swivel brackets at each end of the tubes can be readily tilted to fit against the walls of the shower enclosure. Typically available shower brackets that are not adjustable required that the rod be removed from the bracket cut to size and then fitted back into the bracket. These brackets generally did not allow the rods to swivel and flat placement of the bracket against the wall was a continuous problem. Further, the adjustable tubes of the rod assembly of this invention are curved and fit the contour side of a typical bathtub design.

The curtain rod shower assembly preferably is made of hollow metal rods of a material, such as stainless steel, chrome coated steel, brass, steel/brass/chrome, copper and the like. The assembly can also be made of a rigid polymeric material, such as, include, but are not limited to, polypropylene, high density polyethylene, polyolefin plastomers, enhanced polyethylene, ethylene vinyl acetate copolymers, ionomers, polyamides, such as nylon 6,6, nylon 6, nylon 12 and the like; polyesters, such as, poly(ethylene terephthalate), ethylene vinyl alcohol (EVOH), and poly(vinylidene chloride) (PVDC).

Figure 1:
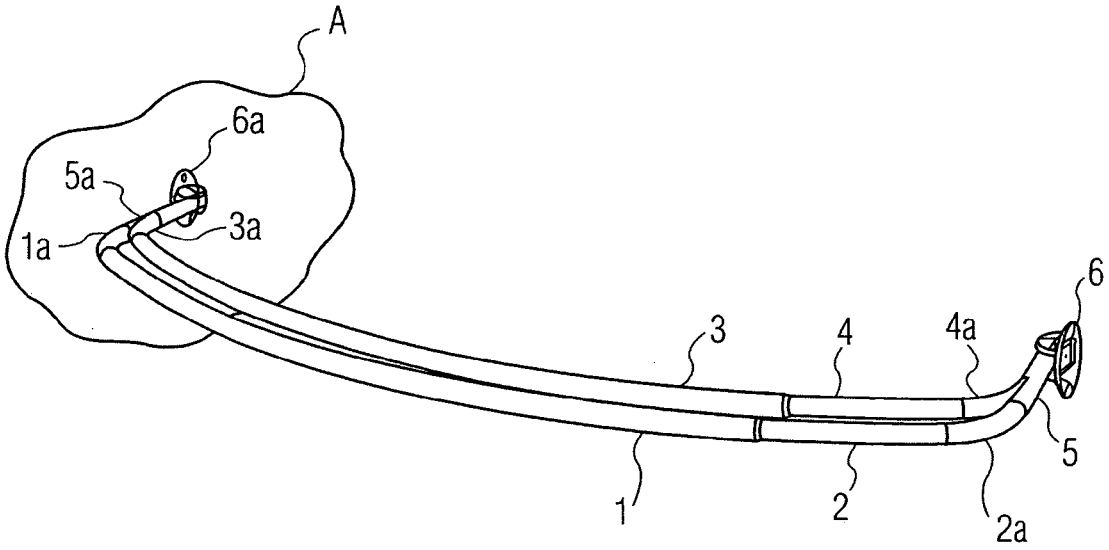
FIG. 1 is a perspective view of the double curtain rod shower assembly.

FIG. 1 shows a perspective view of the double curtain rod shower assembly. The outer rod is a curved tubular telescopically adjustable rod comprising curved rod section 1 having movably positioned therein curved rod section 2 wherein the end of rod section 1 attached to angular section 1*a* that is firmly positioned in end piece 5*a* and the end of rod section 2 attached to angular section 2*a* is firmly positioned in end pierce 5. The inner rod also is a curved tubular telescopic adjustable rod comprising curved rod section 3 having movably positioned therein curved rod section 4 and wherein the end of rod section 3 attached to angular section 3*a* is firmly position in end piece 5*a* and the end of rod section 4 attached to angular section 4*a* is firmly positioned in end piece 5. End piece 5*a* is pivotably attached to swivel bracket 6*a* and end piece 5 is pivotably attached to swivel bracket 6. In the installation of the shower assembly, swivel brackets 6 and 6*a* are attached to the wall of the shower enclosure (not shown). Area A is shown in detail in FIG. 5.

Figure 2:
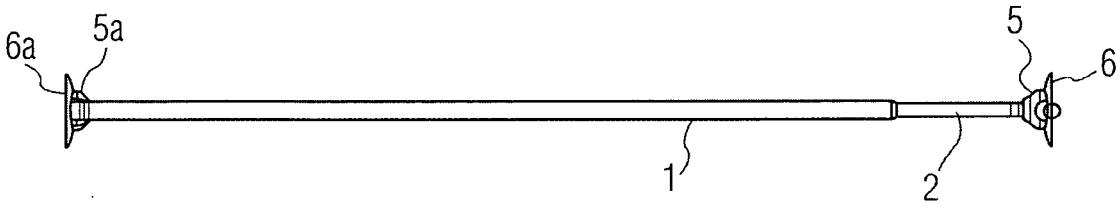
FIG. 2 is a front view of the double curtain rod shower assembly.

FIG. 2 shows a the front view of the double curtain rod shower assembly. The outer adjustable rod comprised of rod sections 1 and 2 is shown where rod section 1 is attached to the end piece 5*a* which in turn is pivotably attached to swivel bracket 6*a*. Similarly, rod section 2 is attached to end piece 5 which in turn is pivotably attached to swivel bracket 6.

Figure 3:
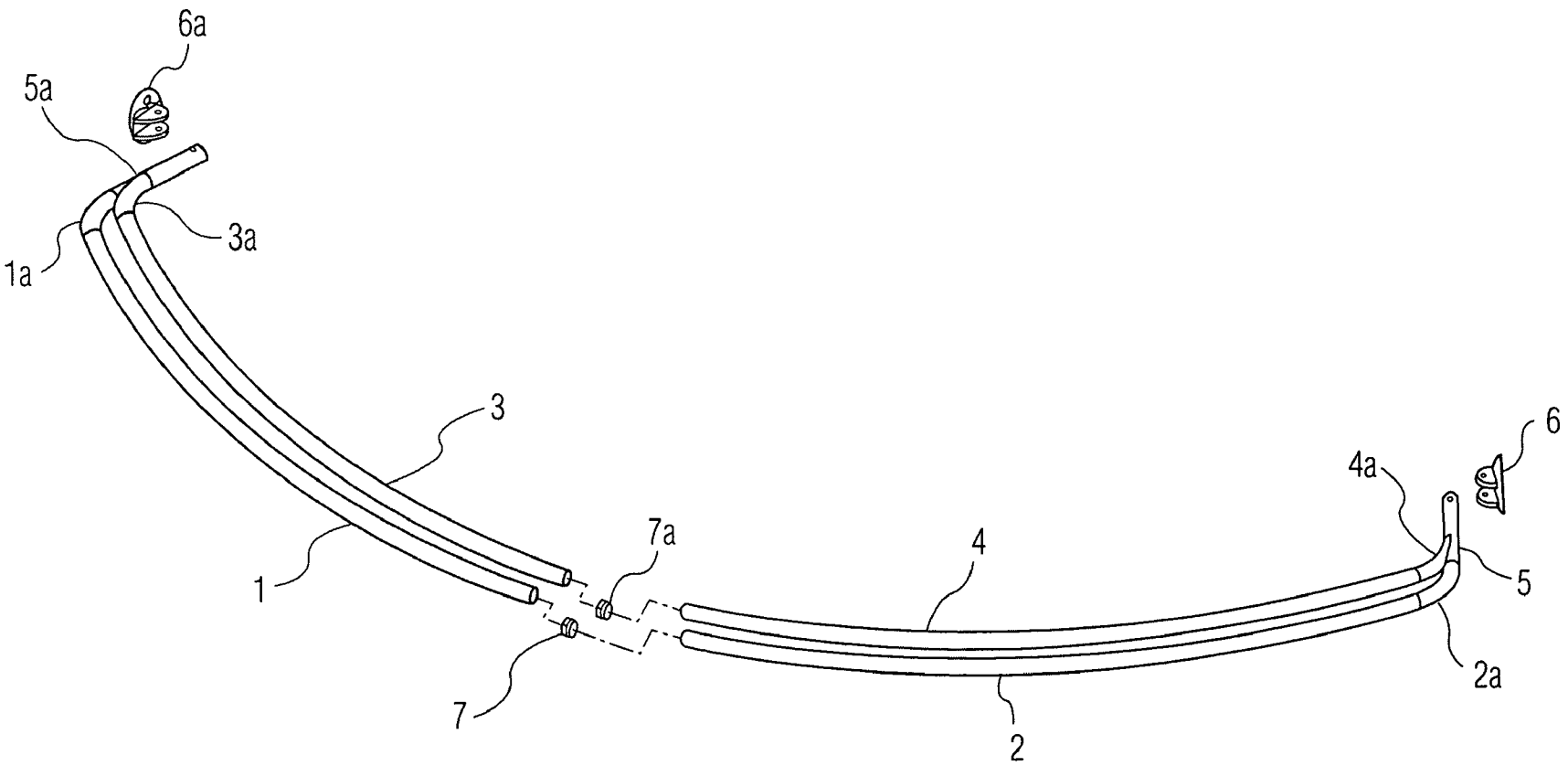
FIG. 3 is an exploded perspective view of the double curtain rod shower assembly.

FIG. 3 shows an exploded perspective view of the double curtain rod shower assembly. In the outer adjustable rod, a plastic sleeve 7 fits over the rod section 2 and slides into rod section 1 and on adjustment of the length of the outer adjustable rod, the plastic sleeve 7 reduces slippage of the rod section. Similarly, for the inner adjustable rod, a plastic sleeve 7*a* fits over the rod section 4 and slides into rod section 3 and on adjustment of the length of the outer adjustable rod, the plastic sleeve 7*a* reduces slippage of the rod section. Rod section 1 attached to angular section 1*a* and rod section 3 attached to angular section 3*a* each fit into end piece 5*a* which in turn is positioned in swivel bracket 6*a*. Similarly, rod section 2 attached to angular section 2*a* and rod section 4 attached to angular section 4*a* each fit into end piece 5 which in turn is position into swivel bracket 6. Typically the angular section of each of the rods are welded to the end piece.

Figure 4:
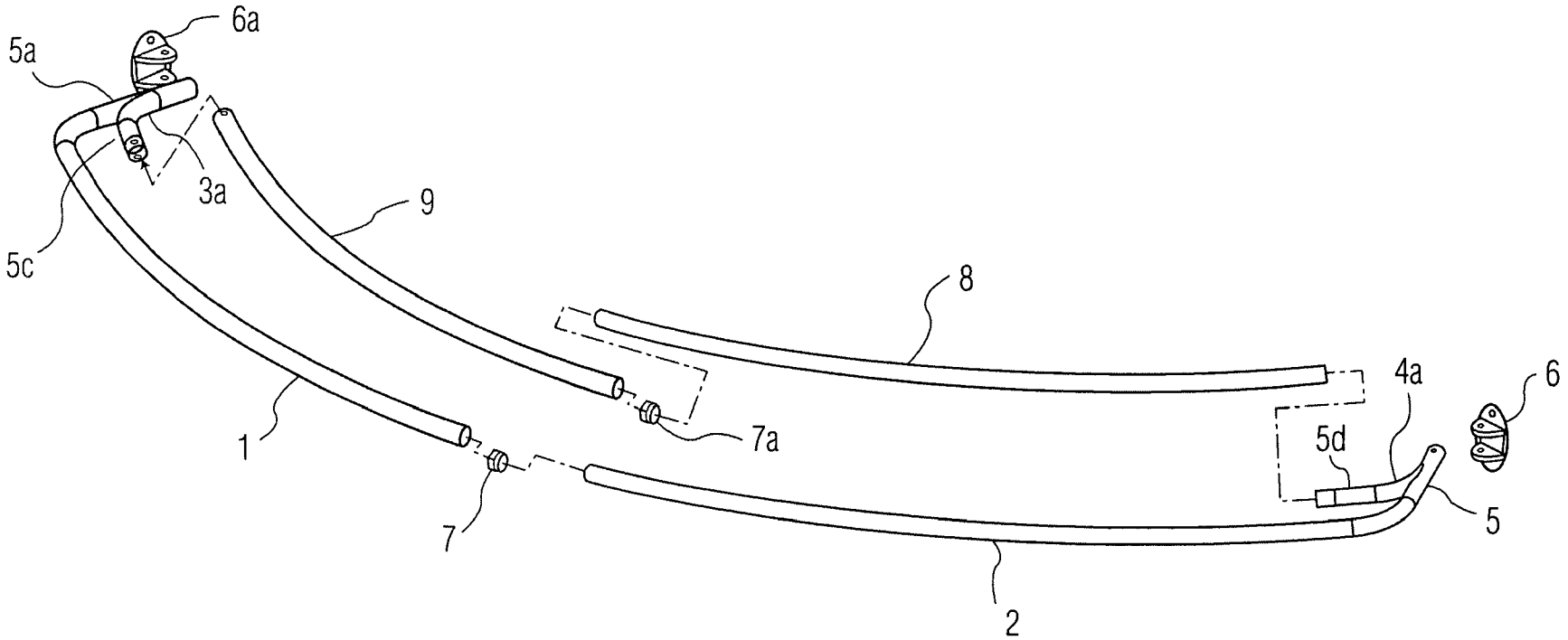
FIG. 4 is an exploded perspective view of the double curtain rod shower assembly utilizing an additional rod section.

FIG. 4 shows an exploded perspective view of the double curtain rod shower assembly utilizing an additional rod section to improve the adjustability of the assembly. In the outer adjustable rod, a plastic sleeve 7 fits over the rod section 2 and slides into rod section 1 and on adjustment of the length of the outer adjustable rod, the plastic sleeve 7 reduces slippage of the rod section. The inner adjustable rod comprises curved rod section 8 over which a plastic sleeve 7*a* is fitted and slides in curved rod section 9. The end of curved rod section 9 is grooved and slides over the groove in tubular connector 5*c* that is firmly attached to angular section 3*a* attached to end piece 5*a*. Similarly, the end of curved rod section 8 is grooved and slides over the grooved tubular connector 5*d* that is firmly attached to angular section 4*a* attached to end piece 5. End pieces 5 and 5*a* are pivotably attached to swivel brackets 6 and 6*b*, respectively.

Figure 5:
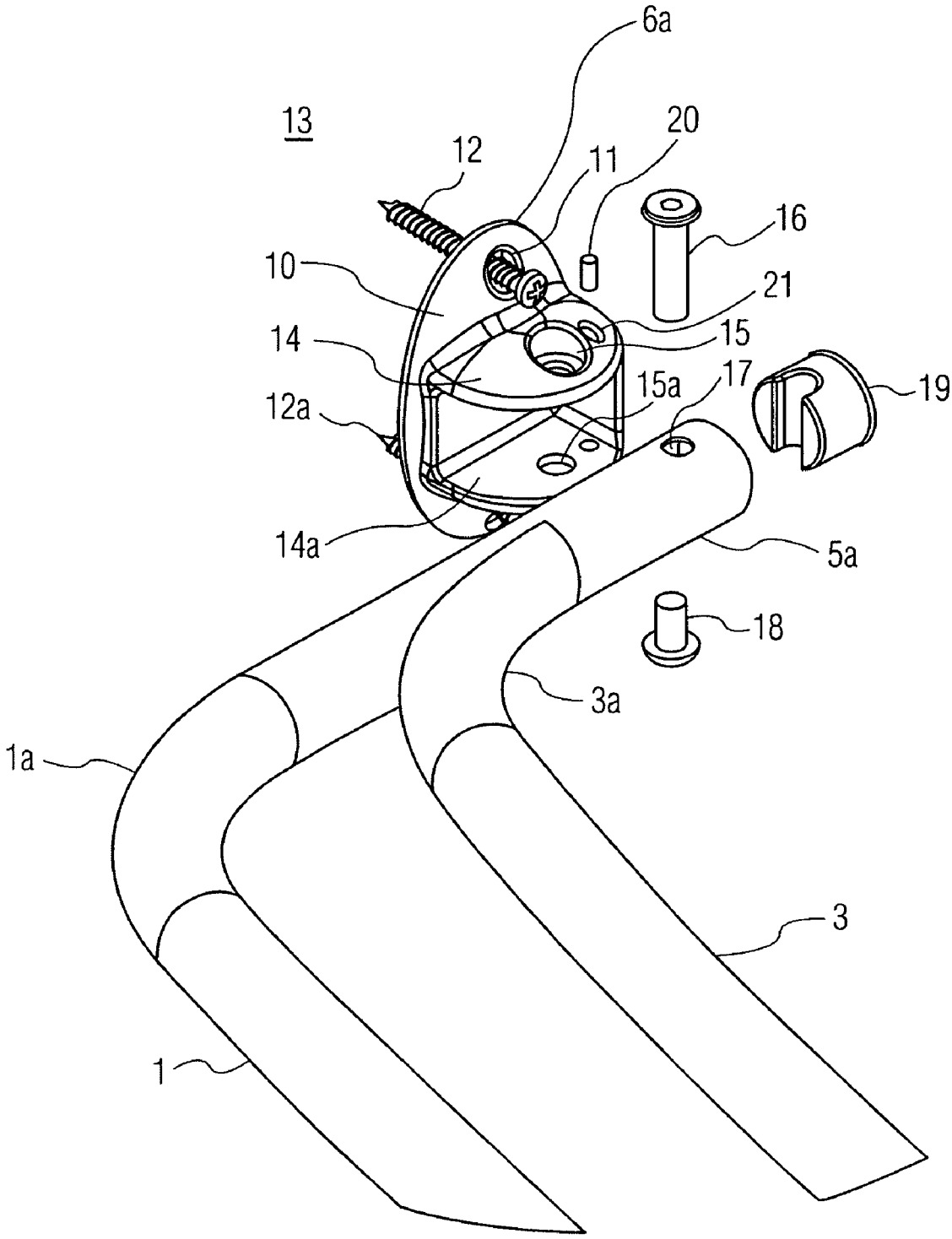
FIG. 5 is an enlarged fragmentary view of area A of FIG. 1 showing the swivel bracket used to attach the double curtain rod shower assembly to a wall.

FIG. 5 is an enlarged fragmentary view of area A of FIG. 1 that shows the swivel bracket used to attach the double curtain rod shower assembly to a wall. The swivel bracket 6*a* has a backing plate 10 which is mounted on a wall 13. The backing plate 10 has two mounting holes 11 and 11*a* (11*a* shown in FIG. 6) and fasteners 12 and 12*a* are positioned in the respective mounting holes 11 and 11*a* and attached to the wall 13. Typically, the fasteners are screws but other types of fastening devices can be used. The swivel bracket can be formed from any of the aforementioned metals or plastics. Attached vertically to the backing plate 10 are two spaced apart lugs 14 and 14*a* (14*a* shown in FIG. 6). Lug 14 has a hole 15 for the lug pin 16. Lug pin 16 is positioned in hole 15 and in hole 17 in the end piece 5*a* and screw 18 positioned in hole 15*a* (shown in FIG. 6) holds lug pin 16 in place. Outer tubular rod section 1 is firmly positioned in angular section 1*a* attached to end piece 5*a*. Similarly, tubular rod section 3 firmly positioned in angular section 3*a* attached to end piece 5*a*. End cap 19 fits into end piece 5*a* and has a notch for lug pin 16. Set Screw 20 is inserted into threaded hole 21 for the set screw 20 and when adjusted, minimizes any movement of the double rod assembly.

Figure 6:
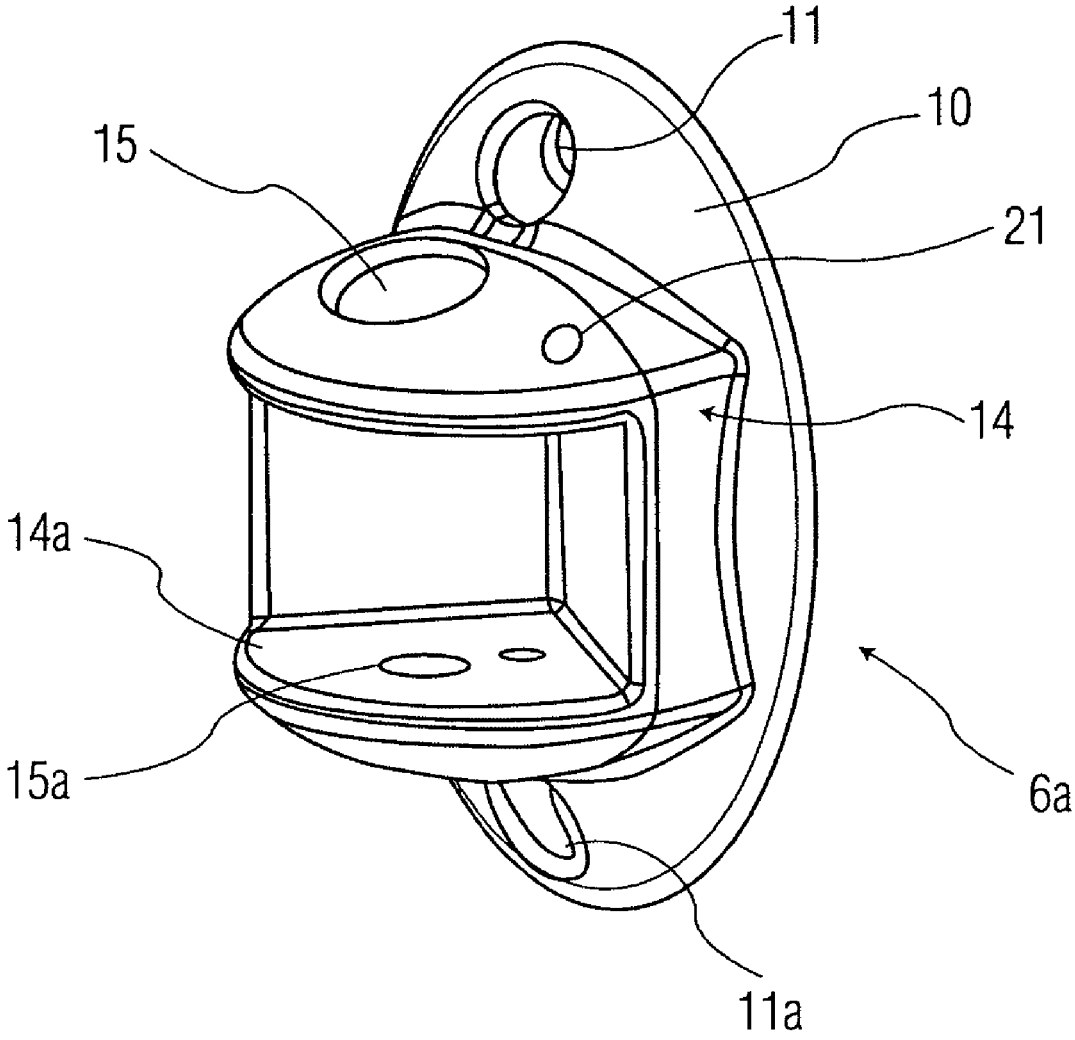
FIG. 6 is a front perspective view of the swivel bracket for holding the double curtain rod and for attachment to a wall.

FIG. 6 is a front perspective view of the swivel bracket for holding the double curtain rod and for attachment to a wall. The backing plate 10 of the swivel bracket has two mounting holes 11 and 11*a* for fasteners and vertically attached to the backing plate 10 are two lugs spaced apart 14 and 14*a* for holding the end piece 5*a* (shown in FIG. 1). Each of the lugs 14 and 14*a* have a hole (15 and 15*a*) for the lug pin 16 and screw 18 respectively, (shown in FIG. 5) that holds the end piece (5*a*) in place and allows the end piece to swivel in the bracket. Threaded hole 21 is for set screw 20 (shown in FIG. 5).

Each of the swivel brackets when mounted on the opposing wall of the shower enclosure, allow for the curtains attached to the dual shower rods to hang in such a position to keep the splashing of shower water in the enclosed shower area. Typically, the curtains are attached to the curtain rods with hanging rings and one of the curtains is positioned inside the edge of the bathtub and the other outside of the bathtub.

The above is directed to preferred embodiments of the invention. The follow claims determine the full scope of the invention

What is claimed is:

1. An adjustable curved double curtain rod shower assembly for hanging and supporting the weight of two shower curtains to form an enclosed shower area, the assembly comprising:

(a) two adjustable curved curtain rods in a horizontal plane, one being an inner rod and the second being an outer rod, each rod comprising a first and a second tubular section wherein the first section fits into the second section thereby providing for telescopic adjustment of each of the rods, and wherein each of the adjustable curtain rods has a polymeric sleeve positioned between the first and second tubular sections thereby providing a frictional surface to prevent the rods from sliding after adjustment;

(b) two end pieces, wherein each end piece comprises an inner rod-accepting portion and an outer rod-accepting portion, wherein each inner rod-accepting portion has attached thereto one end of the inner rod and each outer rod-accepting portion has attached thereto one end of the outer rod, and wherein each end piece further comprises a single hanger-joining portion for pivotably attaching the end piece to an end hanger; and (c) two end hangers having pivotably positioned therein the hanger-joining portions of the two end pieces, wherein the two end hangers are attachable to one wall and to an opposing wall of a shower enclosure, thereby forming an enclosed shower area when shower curtains are attached to each of the rods.

2. The adjustable curved double curtain rod shower assembly of claim 1, wherein each end hanger comprises a bracket assembly comprising a base plate having openings therein for means for attaching the bracket assembly to a wall, and having two vertical members attached to the base plate positioned to receive the hanger-joining portion of the end piece and a pin positioned in the vertical members of the base plate to pivotably fasten the end pieces in the bracket assembly.

3. The adjustable curved double curtain rod shower assembly of claim 1, wherein the first and second tubular sections of the inner rod are removably connected to the end pieces.

4. The adjustable curved double curtain rod shower assembly of claim 1, having curtain hanging rings positioned on each rod to hold a shower curtain in place on each of the rods.

5. The adjustable curved double curtain rod shower assembly of claim 1, wherein the shower area comprises a bath tub with an outer curved side and the adjustable curved curtain rod assembly essentially conforms to the curved outer side of the tub whereby the two shower curtains hanging from the curtain rod assembly drape on the curved side of the tub thereby reducing splashing of water when the shower is in operation.

* * * * *